United States Patent [19]

Papamichalis et al.

[11] Patent Number: 4,625,286

[45] Date of Patent: Nov. 25, 1986

[54] TIME ENCODING OF LPC ROOTS

[75] Inventors: Panos E. Papamichalis; George R. Doddington, both of Richardson, Tex.

[73] Assignee: Texas Instruments Incorporated, Dallas, Tex.

[21] Appl. No.: 373,960

[22] Filed: May 3, 1982

[51] Int. Cl.[4] ..... G10L 5/00

[52] U.S. Cl. ..... 364/513.5; 381/36

[58] Field of Search ..... 381/32, 35; 358/261; 364/715, 722, 723, 513.5

[56] References Cited

U.S. PATENT DOCUMENTS 3,236,947 2/1966 Clapper ..... 381/32
3,478,266 11/1969 Gardenshire ..... 358/261
3,598,921 8/1971 Paine ..... 381/35
3,981,443 9/1976 Lynch et al. ..... 364/715
4,261,043 4/1981 Robinson et al. ..... 364/723

*Primary Examiner*—E. S. Matt Kemeny
*Attorney, Agent, or Firm*—Kenneth C. Hill; James T. Comfort; Melvin Sharp

[57] ABSTRACT

Since the formants in human speech move slowly over time, their slow time-varying behavior provides a source of information redundancy which can be used to reduce the required data rate in encoding of speech. In the present invention, speech is encoded by an adaptive tracking procedure, which follows the time-varying behavior of the speech parameters (e.g. the roots of the LPC inverse filter) with a minimum bit rate.

A sequence of frames of parameters is segmented into locally-smooth segments which are approximated by higher-order orthogonal functions, and the required best-fit approximation order and coefficients are encoded.

13 Claims, 6 Drawing Figures

TIME ENCODING OF LPC ROOTS

BACKGROUND OF THE INVENTION

The present invention relates to a method for encoding speech.

It is highly desirable to be able to store and transmit speech signals using a reduced bandwidth. For example, if 8000 Hz of a speech signal is sampled at the Nyquist rate with 12-bit accuracy, the resulting data rate required is almost 200 kilobits per second of speech. Since the actual information content of speech is far smaller than this, it is extremely desirable to reduce the data rate required to encode speech down to something closer to the actual information content as received by a human listener. Such compressed speech coding has three principal areas of application, each of major importance: synthetic speech, transmission of spoken messages, and speech recognition.

A principal area of efforts to accomplish this end has been linear predictive coding of speech. In the general linear prediction model, a signal $s_n$ is considered to be the output of a system with an input $u_n$ such that the following relation holds:

$$s_n = -\sum_{k=1}^{p} a_k s_{n-k} + G \sum_{m=0}^{q} b_m u_{n-m} \tag{1}$$

where $b_0$ is defined as one, and $a_k$ (k ranging over integers between 1 and p inclusive), $b_m$ (m ranging over integers between 1 and q inclusive), and the gain G are the parameters of the hypothesized system. Since the signal $s_n$ is modeled as a linear function of past outputs and present and past inputs, linear prediction from these outputs and inputs specifies the value of $s_n$.

A slightly simplified version of this model, which is much more tractable, is the autoregressive or all-pole model. In this model, the signal $s_n$ is assumed to be a linear combination of the p most recent past values and of a single input value $u_n$:

$$s_n = -\sum_{k=1}^{p} a_k s_{n-k} + G u_n \tag{2}$$

where G is a gain factor.

By taking the z transform of both sides of this equation, the system transfer function H(z) is $$H(z) = \frac{G}{1 + \sum_{k=1}^{p} a_k z^{-k}} \tag{3}$$

Given a particular signal sequence $s_n$, analysis according to this model produces predictor coefficients $a_k$ and the gain G as speech parameters, in addition to the (assumed) input signal $u_n$.

In a widely used model of human speech, the human voice is modeled as a combination of an excitation function (input signal) with a linear predictive filter. Once the system has been analyzed in this fashion, the excitation function can normally be transmitted at quite a low bit rate.

To represent speech in accordance with the LPC model, the predictor coefficients $a_k$, or some equivalent set of parameters, must be transmitted to permit the correct linear predictor to be used in the resynthesized speech signal which is reconstructed at the receiver. In the prior art, reflection coefficients $k_i$ have often been used as the transmitted parameters. Another alternative set of parameters is the set of poles of the transfer function H(z). The desirable features to be selected for, in deciding which set of parameters is to represent the LPC model, include: 1. The stability of the LPC filter should be guaranteed. This is true with poles or reflection coefficients, but not with predictor coefficients. 2. The parameters transmitted should preferably correspond fairly closely to perceptual parameters, to permit perceptually efficient use of bandwidth. This is a particular advantage of poles. 3. A minimum computational load should be imposed, at both transmitting and receiving ends. 4. Preferably the parameters should have a natural ordering.

An optimized system which satisfies the above requirements is of course very useful not only for transmitting speech, but also for storing synthetic speech. Such a system also has benefits in the areas of speech recognition and speaker identification.

A particular requirement of synthetic speech is a minimum bit rate per second of speech and a minimum computational load at the speech decoder. If these criteria can be achieved, a quite heavy computational load in encoding can be tolerated.

Thus, it is an object of the present invention to provide a method for storing synthetic speech at a very low bit rate, such that the stored synthetic speech can be decoded with only a small computational load.

Simultaneously-filed application No. 373,959, now U.S. Pat. No. 4,536,886, which is hereby incorporated by reference, teaches a method for encoding the roots of the LPC inverse filter. However, since the study of spectrograms shows slow time varying behavior of the formants of human speech, repeated direct encoding of the poles (which show time-varying behavior generally corresponding to that of the formants) would miss the major data redundancy which is provided by the slow change of phase of the poles over time, and thus would consume unnecessary bandwidth.

It is an object of the present invention to provide a method for encoding speech with minimum bandwidth.

It is a further object of the present invention to provide a method for encoding speech by using the poles of the linear predictive coding model, without requiring unnecessary bandwidth.

It is a further object of the present invention to provide a method for encoding speech, according to the poles of the LPC model, which tracks the behavior of pole parameters over time.

It is a further object of the present invention to provide a method for encoding speech according to the poles of the LPC model, which tracks the behavior of pole parameters over time using a minimum number of bits.

The behavior of other speech parameters shows relatively smooth behavior over time period. In particular, the reflection coefficients are likely to be well behaved. A particular advantage of reflection coefficients or poles over predictor coefficients is that stability of the LPC filter, in the receiver, is guaranteed. That is, a relatively small error in the values of the predictor coefficients can introduce instability unpredictably.

Thus, it is a further object of the present invention to provide a method for including the behavior of speech parameters over time, using a minimum number of bits.

Prior art has suggested time-tracking of speech parameters, specifically including LPC parameters, to reduce required bandwidth. See D. T. Magill, "Adaptive Speech Compression for Packet Communication Systems", *Telecommunication Conference Record,* IEEE publication 73 CHO 805-2, 29d 1–5, 1973; J. Makhoul et al, "Natural Communication with Computers", Final Report, Vol. 2, Speech Compression at BBN, Report No. 2976, December 1974; and R. Viswanathan et al, "Speech Compression and Evaluation", Final Report, BBN Report No. 3794, April 1978. The Magill method transmitted a new set of speech parameters only after the vocal track filter was detected to have changed significantly. Change was measured as dissimilarity between adjacent frames, and it was measured by a distance metric which is equivalent to Itakura's log-likelihood ratio. The Makhoul et al and Viswanathan et al approaches interpolated parameters between transmitted and frames, introduced thresholds for the dissimilarity measure so that interpolation between very different data frames is avoided, and used dissimilarity measures other than the log-likelihood ratio.

SUMMARY OF THE INVENTION

The present invention tracks the path of speech parameters over time (within relatively smooth segments), to minimize the bandwidth required for speech encoding. This is done by repeatedly providing as input a full set of speech parameters (e.g. poles of the LPC filter) for each frame interval; segmenting the sequence of frames of parameters into a plurality of locally-smooth segments; successively approximating each parameter within each segment, using a successively higher order of approximation over a specified set of orthogonal functions, until a given standard of fit has been achieved; and encoding the required order of approximation and the approximation coefficients, within each defined segment, and encoding the segmentation end point information.

According to the present invention there is provided: a method for encoding speech, comprising the steps of: providing, at each of a plurality of repeated frame intervals, a set of speech parameters; grouping said frame intervals into segments, such that each of said speech parameters varies smoothly from frame to frame within each of said segments; successively approximating values of each respective one of said parameters within each said respective segment, with linear combinations of orthogonal functions of successively higher order, until a final one of said linear combinations provides a predetermined degree of approximation to said respective parameter within said respective segment; and encoding, for each said respective segment, the number of frames within said segment, and, for each respective parameter within said respective segment, the order of said orthogonal functions in said final linear combination which provides said predetermined degree of approximation, and the respective coefficients of each of said orthogonal functions in said respective final linear combination.

BRIEF DESCRIPTION OF THE DRAWINGS

The present invention will be described with reference to the accompanying drawings, wherein.

DESCRIPTION OF THE PREFERRED EMBODIMENTS

Figure 1:
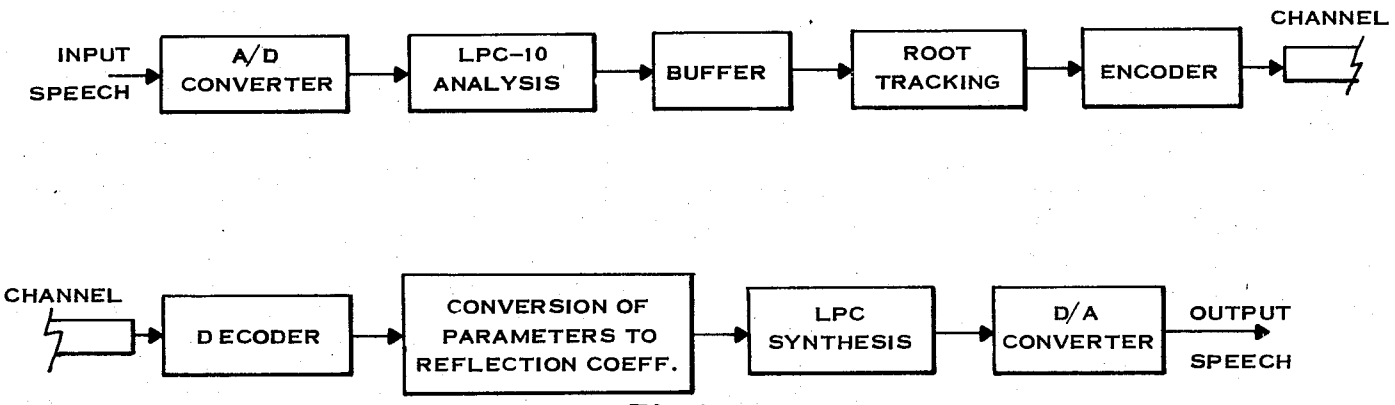
FIG. 1 generally shows a speech transmission system configured according to the present invention.

The present invention provides a further encoding step, which is used after a previous stage of encoding has provided a set of speech parameters, such as LPC poles, at a periodic succession of frame periods. The key steps of the present invention are two: first, a segment end point is established wherever a voiced-to-unvoiced (or vice versa) transition occurs, wherever the dissimilarity between adjacent frames becomes too great, or wherever the parameter tracks are discontinuous; second, an adaptive approximation procedure is used to adaptively approximate each parameter track within each segment, by means of a sequence of successively higher-order approximations by means of a predetermined family of orthogonal functions, wherein the order of approximation is increased until a desired standard of fit is achieved. Not only does this provide a substantial decrease in the bandwidth required for speech coding, but the computational load is shifted disproportionately to the encoding (transmitting) rather than decoding (receiving) end. Thus, the present invention has additional advantages in storage and generation of synthetic speech, particularly where encoded speech messages are to be provided in ROM (or economically equivalent packages) for synthesis in cheap remote devices.

The present invention will be described with primary reference to an embodiment wherein the smooth time behavior of the poles of the LPC model, together with pitch and gain of the LPC residual function, is tracked. However, the present invention can also be used to encode the time behavior of other smoothly varying speech parameters, such as reflection coefficients or their transformations.

The major steps of the present invention are therefore as follows: first, an input is provided which is a sequence of speech frames each frame being represented by a complete set of parameters. In the preferred embodiment, the input speech parameters are a set of 10 LPC poles plus pitch and gain, but as noted, other time series of parameters may be used. The presently preferred frame period is 10 ms, but a shorter frame period can alternatively be used. If the frame period is made much longer, substantial degradation of speech quality begins to occur. Second, where the set of parameters used does not have a natural ordering, it is necessary to identify which parameter values, within each successive frame, correspond to which parameter values in the preceding frame. In the preferred embodiment, this is accomplished by a set of pointers which identify parameter values in adjacent frames. Third, since a series of parameter tracks have now been established, decisions can now be made as to the locally appropriate segment length, i.e. the number of frames over which the values of all parameters can be efficiently tracked using the present invention. By reference to several segmentation criteria, segmentation end points are established for the time series of the whole parameter set. These segments may have varying lengths, and the maximum length may be quite long. Maximum length is limited only by buffering constraints, or by the longest segment of typical (non-silent) speech in which smoothly varying parameter tracts are found. In the preferred embodiment, the maximum segment length is set at 32 frames. Finally, after segment end points have been defined, the time behavior of parameters within each segment can be modeled. In the present invention, this is done using a set of orthogonal functions, with an adaptive degree of fit. That is, in the present invention, each parameter track is successively approximated using a successively higher degree of approximation, until the desired degree of fit is achieved. By using a convenient family of orthogonal functions, such as Legendre polynomials, a good fit can typically be achieved using a polynomial which is of much smaller order than the total number of data points to be fitted. If a good fit cannot be achieved, the order of fit required will in any case be no greater than the number of data points to be fitted. In the preferred embodiment, a maximum order of approximation (8) is also imposed. If an eighth-order approximation is not adequate, no further approximation is done, but the eighth-order fit is relied on.

Figure 2:
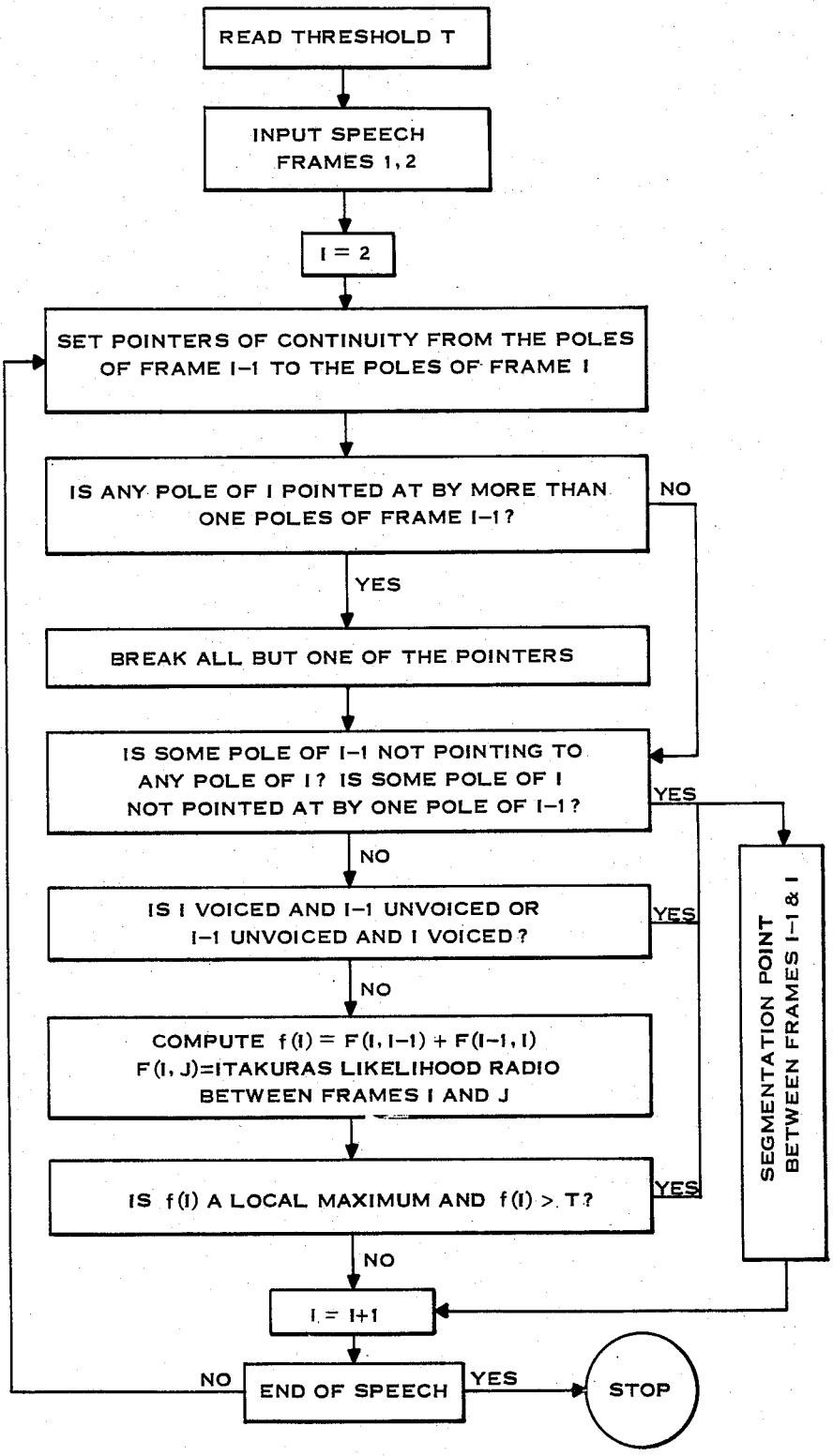
FIG. 2 shows the method of forming parameter tracks and identifying segment end points according to the present invention.

FIG. 2 is a flow chart of the criteria used to analyze continuity of parameter tracks, and to ascertain segment end points. First, the continuity of the set of pole values must be established between adjacent frames. This is done by a pointer, which relates pole values between adjacent frames. To establish the pointer relations, a simple metric is used to define a measure of proximity between adjacent poles. In the presently preferred embodiment, this is defined by the square of the difference in center frequencies, plus a constant factor (typically less than unity) times the square of the difference in bandwidth of the poles. For each of the five poles in the first frame, a pointer is defined, on the basis of this measure of proximity, indicating one of the poles in the second frame. Correspondingly, for each of the poles in the second frame, a pointer is defined, based on the same measure of proximity, indicating one of the poles in the first frame. Note that these two measures need not be exactly reciprocal. That is, it is possible for two poles in the first frame to both have pointers indicating the same pole in the second frame. A check for this condition is made, and where it exists, the pointer which has the highest measure of proximity is retained, and the other pointers are broken. The net result of this operation is that some or all of the poles in the preceding frame are linked by a pointer to a pole in the succeeding frame. If one of the poles in the preceding frame is not linked to a pole in the succeeding frame, or if some pole in the succeeding frame is not pointed to by any pole in the preceding frame, this will define a segmentation end point, unless the unlinked pole is an isolated pole. That is, if a pole is linked neither to a preceding pole nor to a following pole, that pole is judged to be an isolated pole, and does not require that a segment end point be established.

The result of this step is that parameters in successive frames within the segment have been linked, to create a set of parameter tracks. In the preferred embodiment, an additional processing step is now inserted, to further improve the perceptual efficiency of those parameter tracks. First, the bandwidth of all the poles on each parameter track is reviewed, and, if any parameter track contains more than a predetermined percentage (e.g. 50%) both poles having a bandwidth larger than a threshold bandwidth (e.g. 500 Hz), that track is dissolved. The result of this operation is that the segment will contain a number of parameter tracks, and also a number of poles which have not been joined into parameter track. The next step is approximation of all of the unlinked parameter values, in each frame, by a residual polynomial of reduced order. This residual polynomial will incorporate the real poles which may sometimes occur, as well as a large fraction of large-bandwidth poles, which will frequently appear as isolated poles.

Once the residual polynomial, containing all poles which have been excluded from a parameter track, is formed for each frame, the order of the residual polynomial is reduced to second order, preferably by means of the method taught in simultaneously-filed application No. 373,959, now U.S. Pat. No. 4,536,886, which is hereby incorporated by reference. As taught in that application, the polynomial factors corresponding to the poles which are to be lumped together in the residual polynomial are multiplied together, to directly specify the residual polynomial. The coefficients of the residual polynomial are then transformed into a set of reflection coefficients, and all reflection coefficients after the first two are discarded. The first two reflection coefficients, corresponding to a reduced (second order) residual polynomial, are then encoded. Two additional parameter tracks are now established throughout the entire segment, linking the reflection coefficient values which have been established for the reduced residual polynomial, in each frame. In the presently preferred embodiment, the reflection coefficients are transformed into log area ratios. Since the poles which are lumped together in these residual coefficients are typically of lesser perceptual importance, very little perceived quality is lost by the reduced order approximation to their residual polynomials. Moreover, a considerably looser requirement for fit to the parameter track of the residual reflection coefficients is optionally imposed, since the smoothness of these two parameter tracks is not necessarily equal to that of the parameter tracks corresponding to the other poles. Note that, since these two reflection coefficients (and their log area transforms) have a natural ordering, identification of parameter values between adjacent frames is done straight forwardly according to that natural order. Similarly, if the method of the present invention were being applied to a set of speech parameters, such as reflection coefficients, which has a natural ordering, the step of using pointers and proximity measure to define the continuity of parameters would not be required.

Thus, the beginning or end of a pole track provides a first criterion for establishing a segmentation point. A second criterion used is at voice/unvoiced transitions. The third criterion for establishing a segmentation point is a point of local maximum dissimilarity. This is measured by computing Itakura's likelihood ratio between adjacent frames, and establishing a segmentation end point when a symmetrized version of this likelihood ratio (which is a measure of dissimilarity) reaches a local maximum above a given preset threshold. The symmetrized likelihood ratio is defined as $f(I)=F(I,I-1)+F(I-1,I)$, where F(i,j) is the Itakura likelihood ratio between adjacent frames. The Itakura likelihood ratio is defined as $$F(i,j) = \frac{\underline{a}_i^T \underline{R}_j \underline{a}_j}{\underline{a}_i^T \underline{R}_i \underline{a}_i}$$

where $a_i$ is the column vector of the predictor coefficients for the i-th frame, and $R_i$ is the matrix of autocorrelation coefficients for the i-th frame. The (m,n) element of the R matrix is defined as R(m-n), where in the LPC model of equation (2). See Itakura, "Minimum Prediction Residual Principle Applied to Speech Recognition", IEEE Trans. on ASSP, Vol. ASSP-23, p. 67 (1975) which is hereby incorporated by reference. The fourth criterion for segmentation is when the maximum segment length has been exceeded.

The result of the preceding operation is a set of segments, each containing a set of smooth tracks for the full set of parameters. In the presently preferred embodiment, the full set of parameters encoded is: pitch, gain, and two parameters each (phase and amplitude) for each of 5 poles. Segmentation is preferably decided with respect to the behavior of all of these parameters. But once segmentation has been defined, the behavior of each parameter within the segment is preferably modeled separately.

Figure 3:
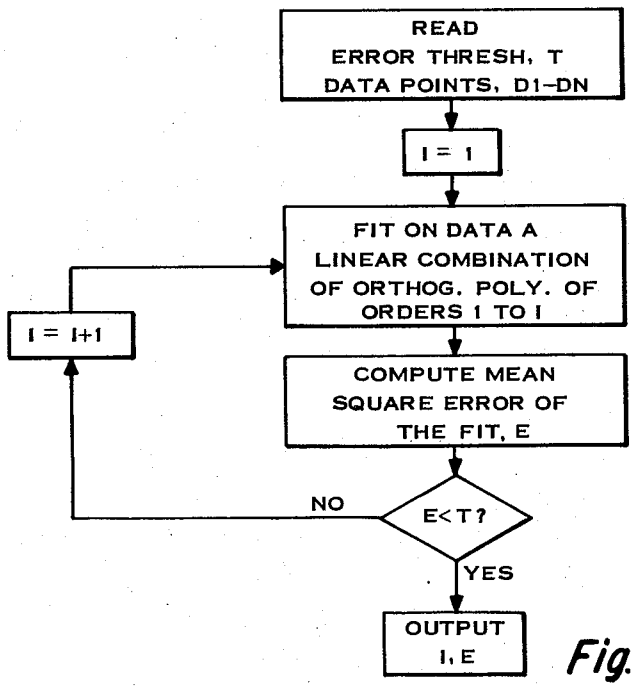
FIG. 3 shows the method of adaptively approximating parameter tracks.

The means used to approximate the behavior of a single parameter within a single segment will now be described. As shown in FIG. 3, an error threshold, for the mean square error of the fit of the approximating curve to all of the individual values of the parameter (the data points) within the segment, is used as a measure of fit. An attempt is now made to approximate the parameter track within this segment by means of a first-order approximation (a linear approximation). If this cannot be made to yield the desired degree of fit, a fit is next attempted using a second order fit (a quadratic approximation). Next a third-order fit would be tried, and so forth.

In practicing the present invention, various orthogonal functions may be used. However, to take advantage of the smooth behavior of pole tracks, a family of orthogonal functions which each have fairly smooth behavior is desirable. To satisfy this criterion, in a first embodiment of the present invention, Legendre polynomials are used. The Legendre polynomials are defined as $$P_n(x) = \frac{1}{2^n n!} \frac{d^n}{dx^n} ((x^2 - 1)^n)$$

See, e.g., G. Arfken, *Mathematical Methods for Physicists*, 2nd Edition (1970). The Legendre polynomials are orthogonal on the interval from $-1$ to $+1$. Thus, by mapping the set number of frames within each segment, which in the preferred embodiment may be between 1 and 32, onto the interval between $-1$ and 1, the relatively well-behaved Legendre polynomials may be used as a family of orthogonal functions. For example, the first few Legendre polynomials are:

$$p0(x)=1;\ p1(x)=x;\ p2(x)=\tfrac{1}{2}(3x^2-1)$$

However, the preferred set of orthogonal functions used in practice in the present invention is slightly different from the conventionally formulated Legendre polynomials. It is particularly desirable, in the successive approximation of the parameter tracks, that the coefficients of the linear combination previously calculated for the lower order orthogonal polynomial fit should not have to be recalculated when the next higher-order polynomial is added. This property is not attained with the conventional Legendre polynomials, and therefore a slightly different set of orthogonal polynomials is used to attain this property.

While various families of orthogonal functions (such as Legendre polynomials, associated Legendre functions, Hermite polynomials, Chebysheff polynomials, etc.) which are orthogonal over a continuous interval can be used in practicing the present invention, the present invention more precisely requires orthogonality at a set of discrete points, rather than over a continuous interval. The presently preferred embodiment uses an optimized set of polynomials at N discrete data points, where N is the number of frames within a segment. For convenience, the abscissae of the N data points are all mapped onto the interval from $-1$ to $+1$. A different family $F_n$ of polynomials $P_j$ is uniquely defined, for each N, by means of the recursive procedure:

$$S_j = \langle P_j, P_j \rangle = \sum_{n=1}^{N} [P_j(x_n)]^2$$

$$B_j = \frac{\langle xP_j(x), P_j(x) \rangle}{S_j} = \frac{1}{S_j} \sum_{n=1}^{N} x_n (P_j(x_n))^2$$

$$C_j = \frac{S_j}{S_{j-1}}$$

$$P_{j+1}(x) = (x - B_j)P_j(x) - C_j P_{j-1}(x)$$

where $P_0(x)$ is defined as uniformly equal to 1, and (for convenience) $x_1 = -1$ and $x_n = 1$. For example, the first few members of the family $F_{11}$ of the polynomials which is thus uniquely defined for N=11 are:

$$P_0(x)=1$$

$$P_1(x)=x$$

$$P_2(x)=x^2-0.4$$

$$P_3(x)=x^3-0.712x$$

$$P_4(x)=x^4-x^2+0.115$$

$$P_5(x)=x^5-1.27x^3-0.305x$$

For computational convenience, the generation of the appropriate polynomials and the calculation of their coefficients is best performed in a single operation, as shown in the subroutine ORTHOPOL1 listed in the Appendix. (Similarly, resynthesis of the polynomials, and calculation of the approximate parameter values for each frame, is preferably carried out in a combined operation, such as exemplified in the subroutine ORTHPOL2 listed in the Appendix.) A crucial advantage of the orthogonal polynomials segmented by the method described is that lower-level coefficients need not be recalculated when the coefficients necessary for a higher-order fit are calculated. Sel Cante and de Bear, *Elementary Numerical Analysis*, (3rd ed. 1980), which is hereby incorporated by reference.

Alternatively, the coefficients of the orthogonal polynomial set may be stored in a look up table. Thus, where (e.g.) a fourth order fit to the parameter values within a segment is necessary, the approximation would be expressed as a $P_4+bP_3+cP_2+dP_1+eP_0$, and the parameters a through e adjusted to achieve the best possible fit. If the best possible fit using a fourth-order combination of polynomials is not good enough, a fifth-order combination will then be tried, where the values of the parameter within the segment are attempted to be modeled as $fP_5+aP_4+bP_3+cP_2+dP_1+eP_0$. By repetition of this step, a good fit is necessarily achieved. The highest degree of fit which will ever be necessary is a fit of order equal to the number of data points in the segment. This is guaranteed, since the polynomials are orthogonal.

Once a fit of a given order has been achieved, the coefficients of the combination of polynomials used to attain that fit may be encoded. Thus, for example, where a segment contains thirteen data points, and a fit with fifth-order fit has been successful, the coefficients a through f of the fifth-order fit are encoded, rather than the values of the parameter at the thirteen data points. Thus a substantial savings in the number of bits required to encode a second of real-time speech is achieved.

The transformation of each segment, used to fit it onto the segment between −1 and +1 so that the preferred orthogonal polynomial approximation can be used, is simply a linear scaling.

In addition, other transformations of the data may be used to achieve perceptually more efficient quantizing. For example, in the presently preferred embodiment, the center frequency of each pole is encoded as the mel of the center frequency in Hz. The bandwidth of each pole is preferably encoded as the logarithm of the amplitude in the complex plane; the energy is preferably encoded as the log of the energy, and the pitch is encoded directly as the time interval between impulses. A coarse order of fit is used for pitch, but quantization step size pitch is preferably made quite small (e.g. three sampling intervals, or about one half of a millisecond). This is because pitch tends to move extremely smoothly, but the ear is quite sensitive to abrupt changes in pitch, so that a fine quantization size is required.

A further improvement in bit rate, at the expense of degradation of quality, is achieved by not encoding the bandwidth of the poles. That is, after the step described above have been used to separate the residual (mostly large-bandwidth) poles and encode them as the reflection coefficients of a reduced residual polynomial, the bandwidth (amplitude) parameter of the remaining poles is simply discarded. At the receiver, a bandwidth is imposed by rule: either a constant bandwidth, such as 100 Hz, is imposed on all of the tracked poles, or some simple modified rule may be used, such as 100 Hz for poles below 2000 Hz, and bandwidth increased above 2000 Hz at 100 Hz of bandwidth per 200 Hz of center frequency.

Figure 4:
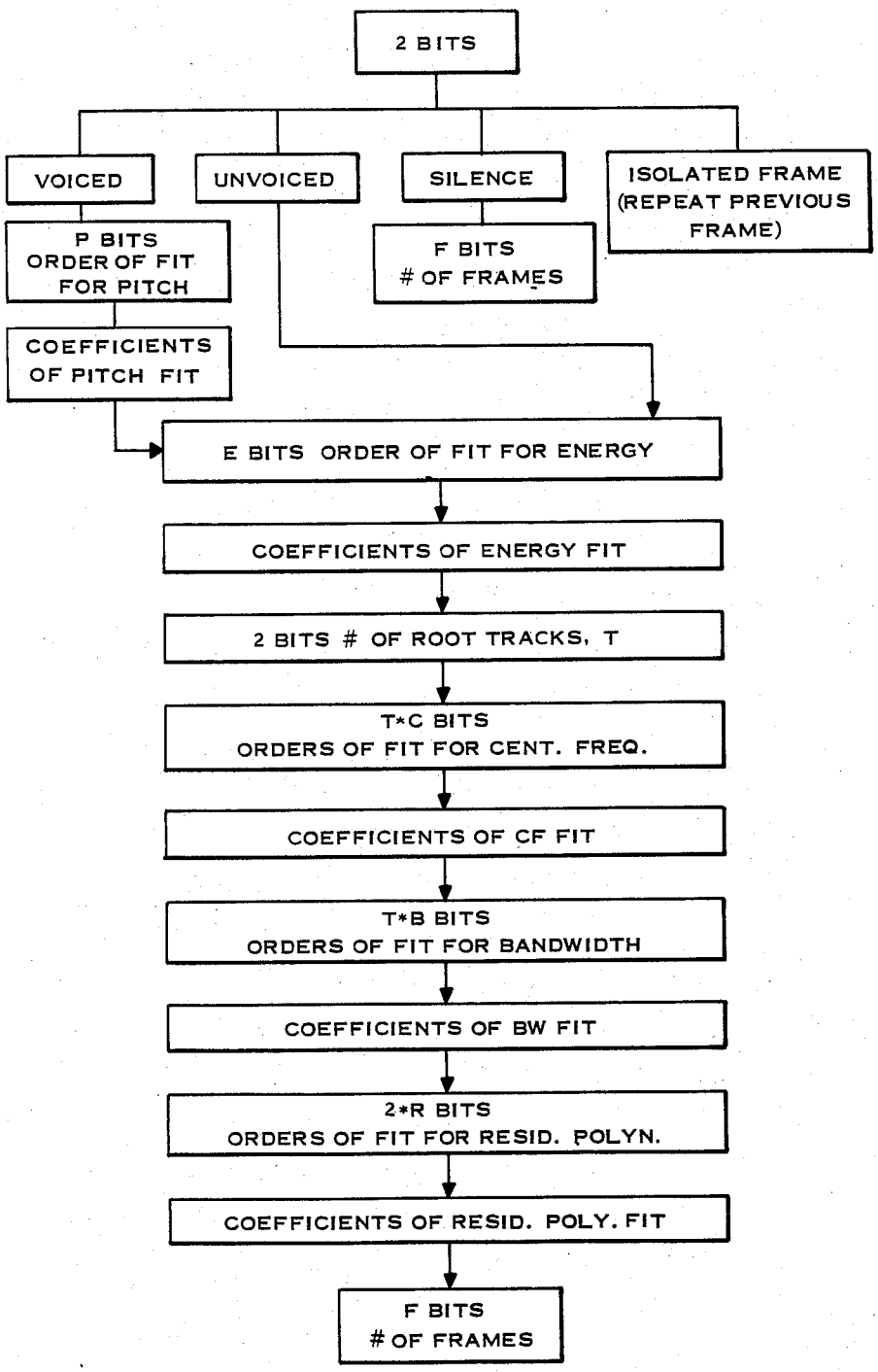
FIG. 4 shows an example of a speech encoding protocol according to the present invention.
Figure 5:
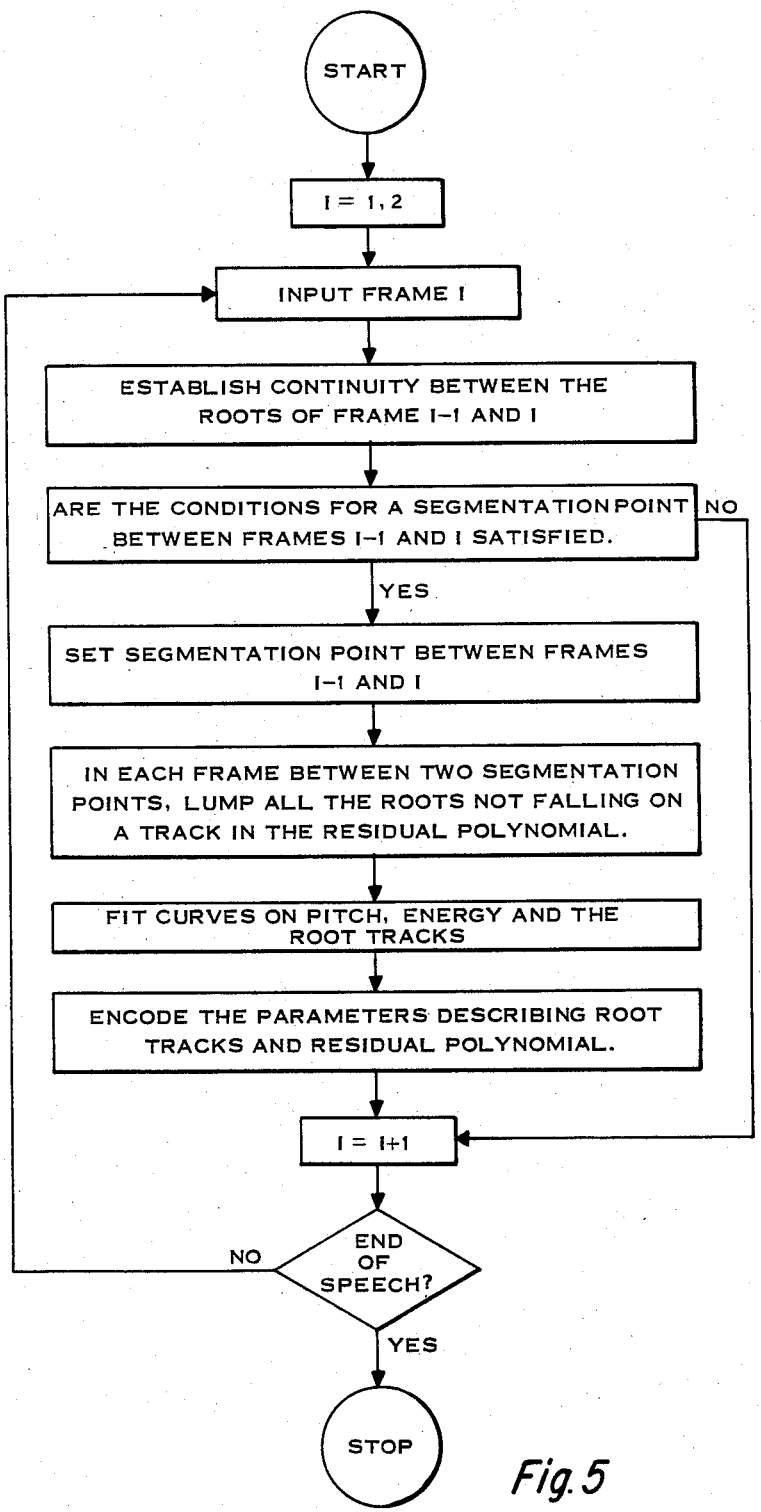
FIG. 5 shows the process of residual polynomial approximation using one embodiment of the present invention.
Figure 6:
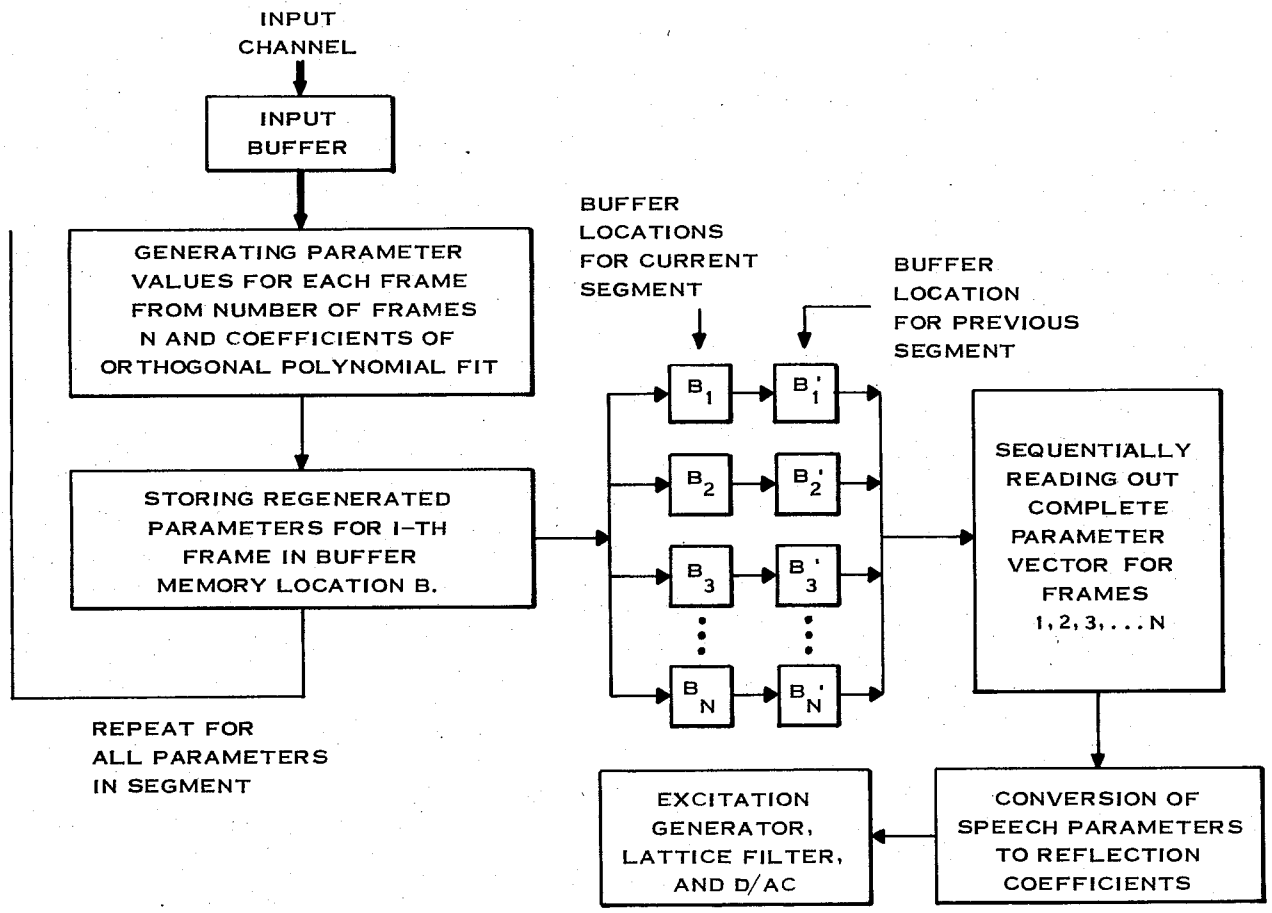
FIG. 6 shows a decoder for use with speech coded according to the present invention.

Thus, a complete encoding scheme as shown in FIG. 4 can be used. Two bits are initially used in each segment, to state whether the segment is voiced, unvoiced, silent, or represents an insulated frame. The number of frames in the segment is then stated. In a voiced frame, a pitch parameter is encoded, so that the order of fit for the pitch parameter is first stated, and then the coefficients which are used to track the pitch are then stated. Additionally, for either a voiced or unvoiced frame, the order of fit for total energy is then stated, followed by the coefficients of energy fit. Next, 2 bits are used to encode the number of root tracks, which may vary (in the presently preferred embodiment). Next, the order of fit required for the center frequency (which corresponds to the phase) of each root track is stated, followed by the coefficients of fit required for each root tract. Similarly, the order of fit required for the bandwidth (corresponding to the amplitude) of each root is stated, followed by the coefficients which are sufficient to track the behavior of the bandwidth of each root with good accuracy. Next, the order of fit for the two parameters required to define the reduced residual polynomial are stated, followed by the coefficients of fitting. Since the frame frequency is built into the system, the code for the number of frames informs the decoder how long this segment lasts.

The encoding process of the present invention is presently accomplished on a VAX11/780 computer. The synthetic speech code generated by the method of the present invention is now preferably loaded into a memory, preferably a read-only memory. For example, a PROM can be burned appropriately, or masks laid out for a ROM, to provide the encoded speech to a remote synthetic speech generator.

The computational requirements on the remote synthetic speech generator are light, and are in large part concerned with buffering. The remote synthetic speech generator preferably decodes the code for a segment, sets up a number of buffers corresponding to the number of frames specified in the segment being decoded, reads the order of fit for each parameter track within the segment, reads the set of coefficients for that parameter track and looks up (or resynthesizes) the set of orthogonal polynomials required to regenerate the actual fitting function in accordance with the linear combination of orthogonal polynomials specified by the set of coefficients just read out, and calculates values of the tracked parameter for each frame using the resynthesized fitting polynomial and stores those values in the corresponding frame buffer. After this operation has been performed for all the parameters in a segment, the buffers may be serially read out as inputs to a conventional linear predictive coding speech synthesis system. Speech is then resynthesized using (e.g.) conventional lattice filter or cascade filter methods.

The present invention is also applicable to transmission as well as to storage of speech. However, in this case the substantial processing required for encoding makes real-time encoding rather expensive. Thus, the most attractive embodiment of the present invention is for storage of synthetic speech.

It will be obvious to those skilled in the art that a wide range of modifications and variations may be used in the method of the present invention, and the scope of the present invention is limited only by the appended claims.

What we claim is:

1. A method for LPC encoding of speech, comprising the steps of:

providing, at each of a plurality of repeated frame intervals, a set of speech parameters;

grouping said frame intervals into segments, such that each of said speech parameters varies smoothly from frame to frame within each of said segments;

successively approximating values of each respective one of said parameters within each said respective segment, with linear combinations of orthogonal functions of successively higher order, until a final one of said linear combinations provides a predetermined degree of approximation to said respective parameter within said respective segment; and encoding, for each said respective segment, the number of frames within said segment, and, for each respective parameter within said respective segment, the order of said orthogonal functions in said final linear combination which provides said predetermined degree of approximation, and the respective coefficients of each of said orthogonal functions in said respective final linear combination.

2. The method of claim 1, wherein said orthogonal functions comprise polynomials.

3. The method of claim 2, wherein said orthogonal functions comprise Legendre polynomials.

4. The method of claim 2, wherein said family of orthongonal functions $P_n(x)$ is defined, in accordance with the number N of said frmes in said respective segment, by the recursive relation:

$$S_j = \sum_{n=1}^{N} (P_j(x_n))^2$$

$$B_j = \frac{1}{S_j} \sum_{n=1}^{N} x_n(P_j(x_n))^2$$

$$C_j = \frac{S_j}{S_{j-1}}$$

$$P_{j+1}(x) = (x - B_j)P_j(x) - C_jP_{j-1}(x)$$

where $x_n$ are equally speced real numbers designating successive ones of said frames within said segment, and $P_{0(x)}=1$.

5. The method of claim 1, further comprising the step of:

identifying corresponding ones of said parameters within adjacent ones of said frames within said respective segment.

6. The method of claim 5, wherein said speech parameters comprise poles of the linear predictive coding filter transfer function.

7. The method of claim 5, further comprising the step of:

identifying excluded values of respective ones of said speech parameters within each of said frames within said segment;

lumping said excluded values together, to form a residual polynomial for each segment;

transforming each said respective residual polynomial to provide corresponding reflection coefficients; and identifying corresponding ones of said reflection coefficients of said residual polynomial over all of said frames;

prior to said step of successively approximating;

whereby said reflection coefficients of said residual polynomial are approximated as only two parameter tracks.

8. The method of claim 1, wherein said grouping step comprises defining a segment end point at each voiced-/unvoiced transition.

9. The method of claim 1, wherein said grouping step comprises defining a segment end point wherever a local maxmum of a dissimilarity measure above a predetermined threshold is attained.

10. The method of claim 9, wherein said dissimilarity measure comprises the sum of the Itakura likelihood ratio of a given frame with respect to its following frame, together with the Itakura ratio of the following frame with respect to its respective preceding frame.

11. The method of claim 1, wherein similar values of respective ones of said parameters are linked between successive frames, such that no parameter value is linked to more than one parameter value in a preceding or following frame, so that the concatenation of linked parameter values so defined defines a parameter track;

and wherein said grouping step comprises defining a segment end point wherever one of said parameter tracks begins or ends.

12. The method of claim 1, wherein said speech parameters comprise reflection coefficients.

13. The method of claim 1, 2, 3, 4, 5, 6, 7, 8, 9, 10, 11, or 12, wherein said encoding step comprises the step of encoding said respective values in a read-only memory.

* * * * *